US006220161B1

(12) United States Patent
De Vroome

(10) Patent No.: US 6,220,161 B1
(45) Date of Patent: Apr. 24, 2001

(54) CHILL ROLLER WHICH PROVIDES UNIFORM TEMPERATURE REGULATION

(75) Inventor: Clemens Johannes Maria De Vroome, Beugen (NL)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 0 days.

(21) Appl. No.: 09/273,619

(22) Filed: Mar. 22, 1999

(30) Foreign Application Priority Data

Mar. 20, 1998 (DE) ..... 198 12 149

(51) Int. Cl.[7] ..... B41F 1/34; B41L 15/14; B41L 49/00; B41L 5/16; F28F 5/02

(52) U.S. Cl. ..... 101/416.1; 101/424.1; 101/480; 492/46

(58) Field of Search ..... 101/424.1, 487, 101/416.1; 492/46; 347/223

(56) References Cited

U.S. PATENT DOCUMENTS

| | | | | |
|---|---|---|---|---|
| 1,820,074 | | 8/1931 | Kilborn . | |
| 1,837,562 | * | 12/1931 | Mayer . | |
| 2,650,034 | * | 8/1953 | Wieber | 241/67 |
| 2,875,985 | * | 3/1959 | Hold | 257/95 |
| 4,090,553 | * | 5/1978 | Beglin | 164/448 |
| 4,093,023 | * | 6/1978 | Frantsenjuk et al. | 165/89 |
| 4,183,298 | | 1/1980 | Cappel et al. . | |
| 4,774,771 | * | 10/1988 | Littleton | 34/62 |
| 4,920,881 | | 5/1990 | Tafel . | |
| 5,595,115 | * | 1/1997 | Rau et al. | 101/142 |
| 5,694,848 | * | 12/1997 | Palmatier | 101/219 |
| 5,881,643 | * | 3/1999 | Silvestre | 101/217 |

FOREIGN PATENT DOCUMENTS

| | | |
|---|---|---|
| 27 08 829 | 9/1977 | (DE) . |
| 32 29 471 C2 | 4/1983 | (DE) . |
| 32 42 066 A1 | 5/1984 | (DE) . |
| 242 852 A1 | 2/1987 | (DE) . |
| 38 02 477 C2 | 8/1989 | (DE) . |
| 41 11 911 A1 | 10/1992 | (DE) . |
| 44 16 421 C2 | 11/1995 | (DE) . |
| 44 31 252 A1 | 3/1996 | (DE) . |
| 195 10 797 A1 | 9/1996 | (DE) . |
| 0 346 046 A2 | 12/1989 | (EP) . |
| 0 468 219 A1 | 1/1992 | (EP) . |

* cited by examiner

*Primary Examiner*—Kimberly Asher
(74) *Attorney, Agent, or Firm*—Herbert L. Lerner; Laurence A. Greenberg; Werner H. Stemer

(57) ABSTRACT

A chill roller having in the interior thereof structural features selected from groups thereof consisting of mixing zones and transport pipes, and having at the exterior thereof a coolant supply pipe and a coolant discharge pipe, includes coolant supplied through the coolant supply pipe to the structural features simultaneously for forming a uniform temperature profile over the entire length of one of the chill roller and a surface of a cylinder jacket thereof; a chill roller stand having a plurality of the foregoing chill rollers; and a rotary printing press having the chill roller stand with a plurality of the chill rollers.

11 Claims, 5 Drawing Sheets

CHILL ROLLER WHICH PROVIDES UNIFORM TEMPERATURE REGULATION

BACKGROUND OF THE INVENTION

Field of the Invention

The invention of the instant application relates to a chill roller for use in the graphic arts industry, in particular for cooling a printed web of material in a rotary printing press.

U.S. Pat. No. 4,920,881 discloses a method of cooling hot webs of material. This disclosure is related to a method for cooling a hot web by passing it across a rotating thermally conductive chill roller having a recirculating coolant therein. In accordance with U.S. Pat. No. 4,920,881, a liquid refrigerant at a temperature and pressure permitting the refrigerant to exist in liquid form is introduced as a coolant to the chill roller, the temperature being also above the dew point of the ambient atmosphere. Likewise, the boiling point of the refrigerant at the desired temperature and pressure is low enough to cause heat to be absorbed by the chill roller primarily by vaporization of the liquid refrigerant. Refrigerant vapor is then withdrawn from the chill roller and is typically refrigerated to reform the liquid phase for return to the chill roller. Typically, chlorofluorcarbon refrigerants are preferred.

The published European Patent Document EP 0 468 219 A1 discloses a chill stand within which a plurality of chill rollers are mounted in a chill roller stand. Wit h this construction, boundary layers of ambient air and oil vapor adhering to both sides of the passing web of material are dissipated while the web of material moves through the chill stand. The chill rollers are mounted on frames, which can be adjusted with respect to one another. By a movement of the respective frames, the chill roller adopts positions in which portions of the moving web being transported in opposite directions around respective chill rollers are kept at a narrow distance from one another to create a boundary layer destroying zone. The boundary layer adhering to those portions of the web of material kept at a narrow distance with respect to one another are dissipated within the boundary layer dissipating zone.

The published European Patent Document EP 0 346 046 A2 discloses a chill roller. This document relates to a chill roller for cooling a web, a printed web of material such as in the graphic arts industry, where a uniform temperature across the chill roller is maintained. Journals support an outer roller assembly and an inner roller assembly. The inner roller assembly is bearing mounted on the inner ends of opposing journals and the outer roll is rotated about the inner roller, which is weighted to free-wheel about the bearings to minimize rotary motion. Coolant is introduced through the journal on one end and into a center tube, where the coolant uniformly flows in an annular space between the rollers and along the length of the inner and outer roller assemblies to circumferentially traverse between the rotating and stationary outer and inner rolls. This coolant flow provides enhanced heat transfer from the outer rotating chill roller to the circulating coolant. Heated coolant collects and returns through a center tube and exhausts through the center tube and out through the journal. Turbulence inducer bars between the inner and outer roller assemblies create a turbulence in the coolant flow between the outer and inner rollers to further enhance heat transfer.

Heretofore, double wall steel cooling rollers with and without a spiral have been in use. The spiral has been constructed to move the water at an even rate between the outer and the inner wall of a cooling roller. However, despite the use of the spiral with the cooling roller, there still remains the problem of an inhomogeneous heat transfer on a cooling roller causing the significant problem of a web drift due to changes, even slight changes, in the diameter of the chill rollers caused by temperature differences. Furthermore, the provided solution of double wall cooling rollers offers little or no possibility at all for a temperature adjustment.

Efforts have been made to ease the major drawbacks of the aforementioned double wall cooling rollers by having a plurality of cooling water circuits connected to the chill roller stand to provide coolants with a different temperature level. Additionally, cooling water bypasses have been constructed having a pump or three-way valves and the corresponding bypass-piping systems. The additional costs involved with these efforts and the outcome thereof have not justified the approaches taken to address the problem in this manner.

SUMMARY OF THE INVENTION

Taking the state of the art as outlined above into consideration, it is accordingly an object of the invention to provide a chill roller having readily adjustable temperatures. A further object of the invention is to prevent the occurrence of oil condensate on the surfaces of a respective chill roller.

With the foregoing and other objects in view, there is provided, in accordance with one aspect of the invention, a chill roller having in the interior thereof structural features selected from groups thereof consisting of mixing zones and transport pipes, and having at the exterior thereof a coolant supply pipe and a coolant discharge pipe, comprising coolant supplied through the coolant supply pipe to the structural features simultaneously for forming a uniform temperature profile over the entire length of one of the chill roller and a surface of a cylinder jacket thereof.

In accordance with another feature of the invention, the mixing zones are connected in series.

In accordance with a further feature of the invention, the mixing zones are connected to a central distribution pipe.

In accordance with an added feature of the invention, the mixing zones have a temperature therein equal to the temperature in the central distribution pipe.

In accordance with an additional feature of the invention, central distribution pipe is fixed to a first end face of the chill roller.

In accordance with yet another feature of the invention, the central distribution pipe is formed with a plurality of outlet openings assigned to the mixing zones.

In accordance with yet a further feature of the invention, the outlet openings are annular openings.

In accordance with a first alternative feature of the invention, the outlet openings are bores.

In accordance with a second alternative feature of the invention, the outlet openings are perforations formed in the central distribution pipe.

In accordance with yet an added feature of the invention, the outlet openings, respectively, have a cross section that increases over the length of the chill roller.

In accordance with yet an additional feature of the invention, the mixing zones are separated from one another by partitions.

In accordance with still another feature of the invention, the partitions, respectively, have an annular shape.

In accordance with still a further feature of the invention, the partitions are circular plates.

In accordance with still an added feature of the invention, the respective mixing zones are provided with respective coolant outlets formed between the surface of the cylinder jacket and the respective partitions.

In accordance with still an additional feature of the invention, the respective coolant outlets of the mixing zones have respective cross sections which increase over the length of the surface of the cylinder jacket of the chill roller.

In accordance with another feature of the invention, a plurality of the transport pipes are distributed in annular form within the hollow interior of the chill roller.

In accordance with a further feature of the invention, a coolant flow emerging from the transport pipes contacts the surface of the cylinder jacket of the chill roller simultaneously over the length thereof.

In accordance with another aspect of the invention, there is provided a chill roller stand comprising a plurality of chill rollers, respectively, having in the interior thereof structural features selected from groups thereof consisting of mixing zones and transport pipes, and having at the exterior thereof a coolant supply pipe and a coolant discharge pipe, each of the chill rollers comprising coolant supplied through the coolant supply pipe to the structural features simultaneously for forming a uniform temperature profile over the entire length of one of the respective chill roller and a surface of a cylinder jacket thereof.

In accordance with a further aspect of the invention, there is provided a rotary printing press having a chill roller stand comprising a plurality of chill rollers, respectively, having in the interior thereof structural features selected from groups thereof consisting of mixing zones and transport pipes, and having at the exterior thereof a coolant supply pipe and a coolant discharge pipe, each of the chill rollers comprising coolant supplied through the coolant supply pipe to the structural features simultaneously for forming a uniform temperature profile over the entire length of one of the respective chill roller and a surface of a cylinder jacket thereof.

In accordance with an added aspect of the invention, there is provided a chill roller having a coolant supply pipe, a central distribution pipe for receiving coolant therefrom, and a coolant discharge pipe, comprising supply openings formed in the coolant supply pipe for supplying a coolant flow of fresh coolant therethrough, the rate of the coolant flow in comparison with that of a resultant coolant flow of preceding mixing zones being kept constant over the length of the chill roller.

In accordance with another feature of the invention, the central distribution pipe has a frustoconical shape.

In accordance with a further feature of the invention, the chill roller has a funnel-shaped flow region defined between an interior cylindrical surface of the chill roller and the frustoconical central distribution pipe.

In accordance with a concomitant feature of the invention, the downwardly tapered end of the central distribution pipe is proximal to the discharge pipe.

The construction according to the invention has numerous advantages. Because the coolant is supplied to all of the mixing zones or chambers simultaneously, no zones within the chill roller interior can contain a fluid that has developed a temperature different from the temperature of the fluid supplied. The surface of the chill roller is always in contact with a liquid having the same temperature over the entire width of the chill roll. Therefore, regardless of the flow rate of the coolant, an even temperature profile across the surface of the chill rollers is assured. Within the various mixing chambers or zones, a coolant circulation can be created that, due to the circulation, enhances heat transfer.

Furthermore, the aforementioned mixing chambers or zones are connected in series with one another allowing for a continuous coolant flow towards the discharge pipe. Because all of the various mixing chambers are connected to the central supply or distribution pipe, all of the mixing chambers or zones can be supplied with coolant simultaneously. The temperature in all of the mixing chambers or zones across the entire length of the chill roller is the same due to the connection thereof to the central supply or distribution pipe, thus an even temperature profile can be achieved on the surface of the chill roller. In a very simple and cost effective manner, the central supply or distribution pipe can be attached to one side of an end flange of the chill roller. The supply of coolant to the respective mixing chambers or zones can very easily be achieved through supply openings formed in the central supply or distribution pipe and communicating with the various mixing chambers or zones. The various supply openings to the different mixing chambers or zones can be in the form of bores, slots or perforations in the central supply or distribution pipe. The cross sections of the various supply openings increase over the length or breadth of the chill roller so that a maximum amount of coolant is fed to the mixing chamber or zone at the discharge side of the chill roller, i.e., the "warm" end of the chill roller.

The mixing chambers or zones provided in the interior of the chill roller are separated from one another by partitions attached to the axially extending central supply or distribution pipe.

The partitions may have an annular shape or be manufactured as circular plates attached to the control supply or distribution line. To enable the supplied coolant to circulate in a flow direction towards the discharge pipe, the mixing chambers or zones are provided with respective outlet openings, the cross sections of which likewise increase in the flow direction of the coolant to provide for an even coolant flow.

In an alternative embodiment of the invention, a plurality of transport pipes is distributed within the hollow interior of the chill roller. To provide for an even temperature profile on the surface of the respective chill roller, a coolant flow emerging from the transport pipe simultaneously contacts the inner surface of the cylinder jacket of the chill roller. Upon contact with the respective inner surface of the cylinder jacket, the coolant flow is directed towards the interior of the chill roller from which it flows through a respective opening to an assigned discharge pipe.

Chill rollers according to the invention are used in chill roller stands. Depending upon the speeds of the printed webs to be chilled, the number of chill rollers in a chill roller stand can vary between five and up to nine. A respective chill roller stand having a plurality of chill rollers is disposed after or downline from the drier of a rotary printing press after the web has passed a number of printing units.

Although the invention is illustrated and described herein as embodied in a chill roller, it is nevertheless not intended to be limited to the details shown, since various modifications and structural changes may be made therein. without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
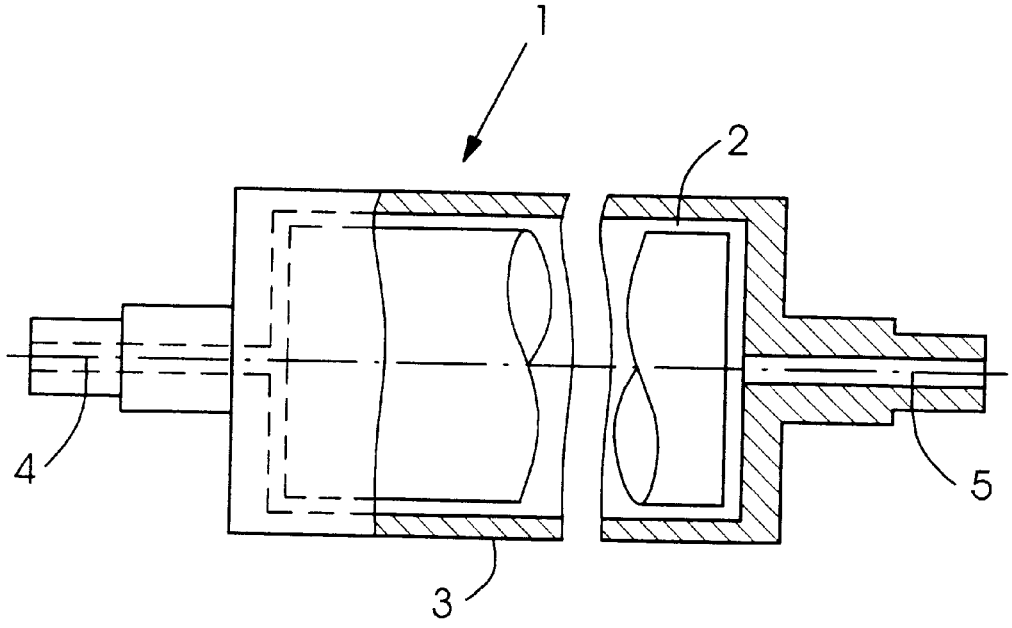
FIG. 1 is a diagrammatic longitudinal view, partly in section and partly broken away, showing a double wall steel chill roller according to the invention.

Referring now to the drawings and, first, particularly to FIG. 1 thereof, a double wall steel chill roller 1 is shown therein diagrammatically.

The double wall chill roller 1 is journaled between two side frames of a chill roller stand that is not otherwise shown in greater detail here. A pipe system including a supply pipe 4 and a discharge pipe 5 is attached to respective sides or ends of the chill roller 1. The flow direction of a respective coolant used therein is from the supply to the discharge side of the chill roller 1. Between an inner portion of the chill roller and an outer surface on a cylinder jacket 3 thereof, a hollow portion 2 is formed, that allows for a flow of coolant close to the inner side or surface of the cylinder jacket 3.

Figure 2:
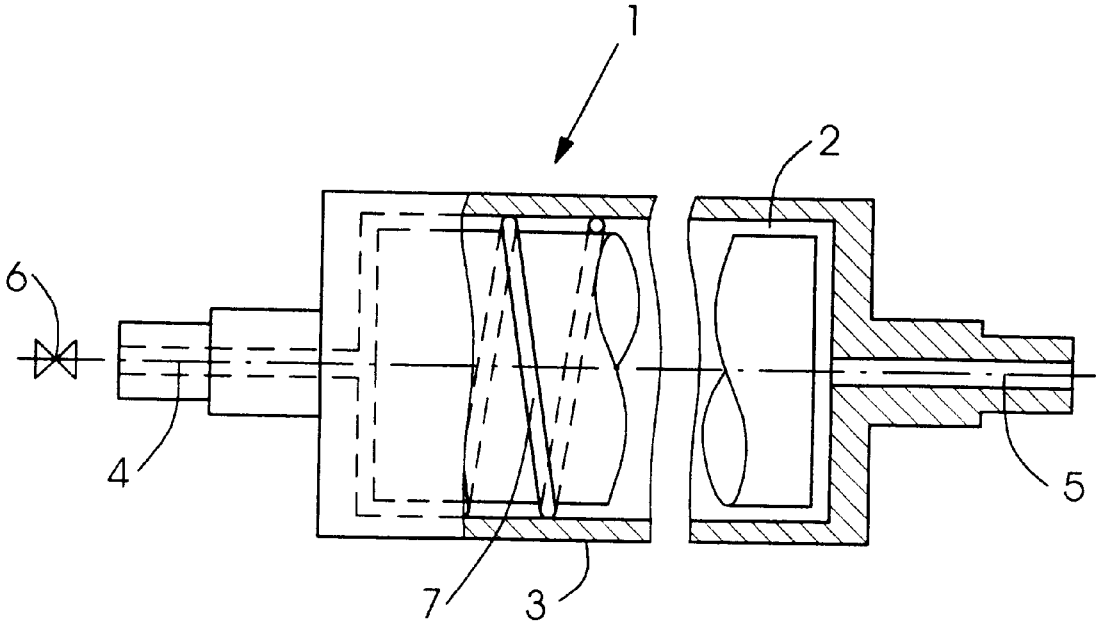
FIG. 2 is a view like that of FIG. 1 of another embodiment of the double wall steel chill roller having a spiral integrated therein for moving coolant at an even rate.

FIG. 2 is a simplified diagram of the double wall steel chill roller 1 provided with a spiral winding integrated therein.

In this conventional embodiment that is state of the art, a valve 6 adjusting coolant flow is assigned to the supply pipe 4 of the chill roller 1. The spiral winding 7 extending in the hollow interior of the chill roller 1 permits the coolant to flow at a uniform or even flow rate.

Figure 3:
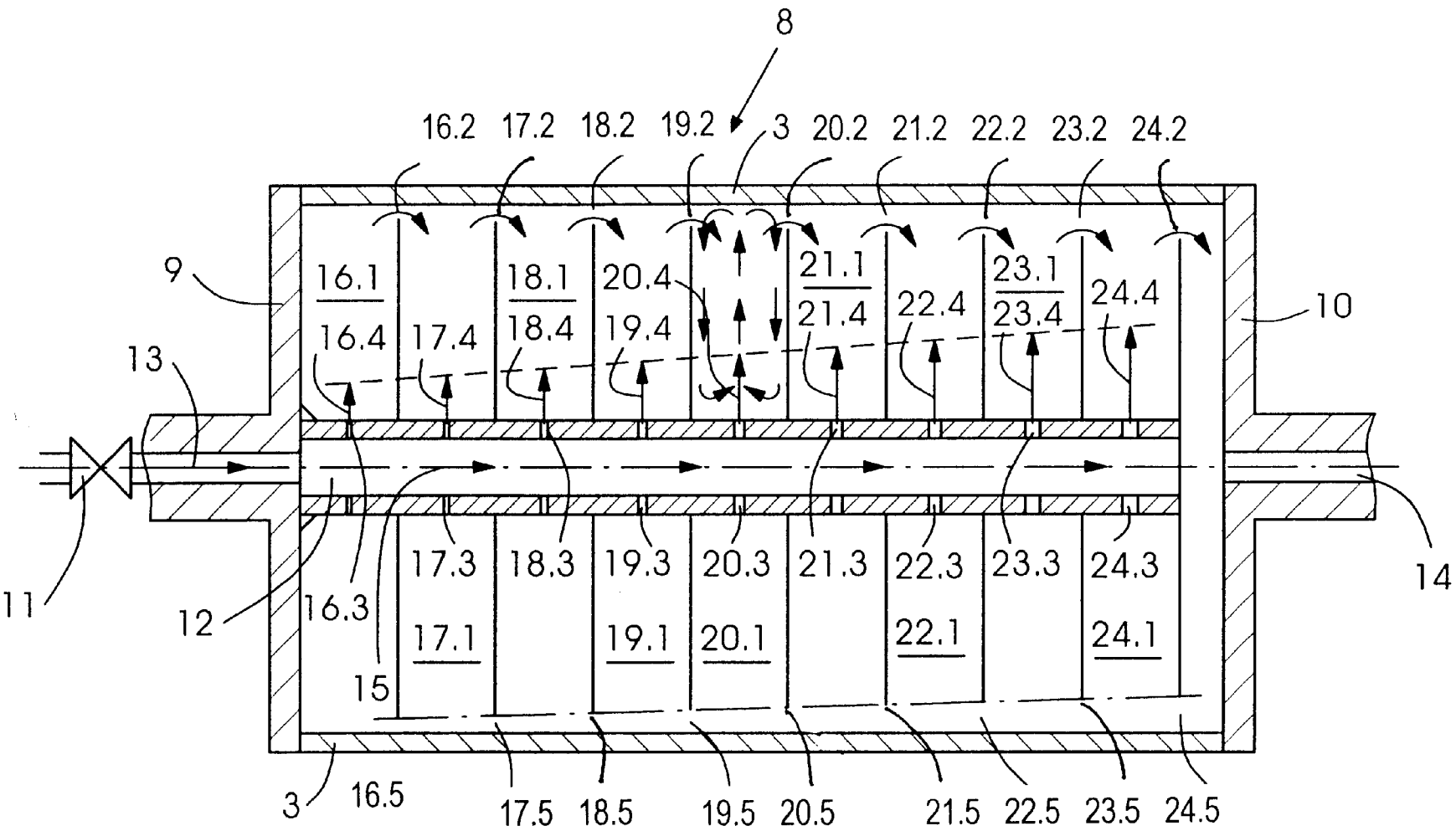
FIG. 3 is a longitudinal sectional view of an embodiment of the chill roller according to the invention.

FIG. 3 is a longitudinal sectional view of a chill roller according to the invention of the instant application. The chill roller 8 has two end faces 9 and 10, namely on a first end flange and a second end flange, respectively. A supply pipe 13 is integrated with the first end flange 9, and supplies coolant to the chill roller 8, whereas the second end flange 10 is integrated with a discharge pipe 14 via which the coolant is discharged from the chill roller 8. On the supply side, a valve element 11 is mounted through which the supply of coolant to the interior of the chill roller 8 is controllable and various flow rates of coolant can be adjusted. The coolant supplied via the supply pipe 13 moves in a flow direction represented by the arrow 15 through the interior of the chill roller 8.

A central supply or distribution pipe 12 is attached to the first end flange 9 of the chill roller 8 and extends axially over the greatest part of the chill roller 8. A multiplicity of partitions 16 to 23 are arranged on the outer circumference of the central supply or distribution pipe 12.

Between the first end flange 9 and the partition 16, a first mixing zone or chamber 16.1 is formed, that extends annularly around the central supply or distribution pipe 12. The first mixing zone or chamber 16.1 is supplied with the coolant through a supply opening 16.3 formed in the central supply or distribution pipe 12. The partition 16 effecting the separation of the first mixing zone or chamber 16.1 is formed with an outlet 16.5 between the inner surface of the cylindrical jacket 3 of the chill roller 8 and an end portion of the partition 16 to allow for the escape of coolant from the first mixing zone or chamber 16.1. The next mixing zone or chamber 17.1 is formed between the aforementioned partition 16 and a further partition 17 attached to the central supply or distribution pipe 12. This respective mixing zone or chamber 17.1 is supplied with the coolant via a supply opening 17.3 formed in the central supply or distribution pipe 12. The partition 17, being a circular plate for example, is likewise formed with an outlet 17.5 via which the coolant enters the next abutting mixing zone or chamber 18.1.

For clarification reasons, it is noted at this juncture that the flow of coolant to the mixing zones or chambers 16.1 and 17.1 via the supply openings 16.3 and 17.3, is equal to the flow of coolant passing the outlet 17.5 of the mixing zone or chamber 17.1 due to the continuity equation. This principle applies to the length or breadth of the entire chill roller shown in FIG. 3 of the drawing of the invention of the instant application. As can be derived from the drawing, the further partition 18 forms a third mixing zone or chamber 18.1 which, in turn, is supplied with coolant via a supply opening 18.3. In accordance with the gist of the invention, the partition 18 is formed with an outlet 18.5 from the mixing zone or chamber 18.1, the outlet 18.5 being located between a respective end portion of the partition 18 and the inner surface of the cylindrical jacket 3. Furthermore, the outlet 18.5 is of such dimension that the flow of the mixing zones or chambers 16.1, 17.1 and 18.1 passes therethrough to enter a next mixing zone or chamber 19.1. The mixing zone or chamber 19.1 is defined by or formed between the partition 18 and a partition 19, respectively, and is supplied with coolant through a supply opening 19.3 formed in the central supply or distribution pipe 12, and an outlet 19.5 is likewise formed between the cylindrical jacket 3 and an end portion of the partition 19 for the coolant flow of the preceding mixing zones or chambers 16.1, 17.1 and 18.1.

With reference to the central mixing zone or chamber 20.1 that is formed between the partitions 19 and 20, respectively, the direction of flow within a mixing zone or chamber is described hereinafter. This explanation applies as well for all of the mixing zones or chambers shown in FIG. 3. Thus, through a supply opening 20.3 formed in the central supply or distribution pipe 12, coolant enters the central mixing zone or chamber 20.1 and contacts the inner surface of the cylindrical jacket 3 of the chill roller 8. After having contacted the inner surface of the jacket 3, the flow is divided in respective directions towards both partitions 19 and 20, respectively, then continues to the bottom of the mixing zone or chamber 20.1 of the chill roller 8, mixing with the continuously supplied coolant and maintaining the temperature constant in the mixing zone or chamber 20.1. It is again noted in this regard that the outlet 20.5 of the mixing zone or chamber 20.1 is dimensioned so that the flow of coolant supplied by the previously arranged mixing zones or chambers 16.1, 17.1, 18.1, 19.1 and 20.1 passes through the opening of the outlet 20.5.

In addition to the coolant flow passing from the preceding mixing zones or chambers through the outlet 20.5, coolant enters in the form of a water jet through the supply opening 20.3 from the central supply or didtribution pipe 12 into the mixing zone or chamber 20.1. This freshly entering coolant has a temperature of 10° C., for example, and is warmed by contact with the inner surface of the cylindrical jacket 3 of the chill roller 8 to 13° C., for example. After flowing along the partitions 19 and 20 of the mixing chamber 20.1, the coolant flowing back is warmed to about 16° C., for example, before it mixes with the tempered or warmed coolant freshly entering through the supply opening 20.3. In this manner, heat is removed from the cylindrical jacket 3 of the chill roller 8.

In addition to the central mixing chamber 20.1, additional mixing chambers 21.1, 22.1, 23.1 and 24.1 are arranged in the axial direction up to the second end flange 10. The principle of coolant supply via supply openings 21.3, 22.3, 23.3 and 24.3 and the discharge of coolant through the various different outlets 21.5, 22.5, 23.5 and 24.5 follows the same principle described in connection with the aforementioned mixing chambers 16.1, 17.1, 18.1, 19.1 and 20.1. It is further noteworthy that, along the length of the central supply pipe 12, the various cross sections of the respective supply openings 16.3 to 24.3 have increasing dimensions, i.e., the coolant supply to each of the respective mixing chambers 16.1 to 24.1 increases over the length or breadth of the chill roller 8. Consequently, there is a greater amount of coolant supplied to the "warm" side of the chill roller, i.e., the second end flange 10, in comparison with the "cold" side of the chill roller, namely the first end flange 9. This can be derived from FIG. 3, wherein each of the coolant supply flows 16.4 to 24.4 to the respective mixing chambers 16.1 to 24.1 is symbolized by vertical arrows of different length. The broken line drawn between the respective tips of the different vertical arrows thus is somewhat inclined towards the first end flange 9 of the chill roller 8.

In accordance with the principle of the chill roller illustrated in FIG. 3, all of the respective mixing chambers 16.1 to 24.1 are supplied with coolant simultaneously from the central supply pipe 12. The coolant entering into the mixing chambers 16.1 to 24.1 has the same temperature, although it varies in flow rate due to the changing cross sections of the supply openings 16.3 to 24.3 as viewed in the axial direction of the chill roller 8. Because all of the mixing chambers 16.1 to 24.1 are being filled with a liquid coolant having the same temperature in each mixing chamber 16.1 to 24.1, the entire surface of the cylindrical jacket 3 of the chill roller 8 will be contacted by a fluid which, although in different mixing chambers, has substantially the same temperature. Consequently, an even temperature profile on the surface of the cylindrical jacket 3 of the chill roller 8 according to the invention will be attained.

Because the coolant supplied to the interior of the chill roller 8 has the tendency to increase in temperature over the length or breadth of the chill roller 8, due to heat transfer from the hot printed web coming out of the dryer, the flow rate supplied to the "cold" end of the chill roller 8 is lower in comparison with the flow rate fed to the mixing chamber 24.1 via the supply opening 24.3 at the "warm" end, i. e., the second end flange 10. Due to the constantly increasing cross sections of the respective outlets 16.5 to 24.5 linking all the mixing chambers 16.1 to 24.1 with one another, a constant flow of coolant is maintained through the entire length or breadth of the chill roller 8.

The supply flow rate of coolant to the chill roll 8 can be adjusted via a valve 11 that is integrated into the supply line to the chill roller 8. In order to prevent oil condensation from forming on the respective surfaces of the chill rollers 8 of a chill roller stand 110 arranged after or downline from a dryer of a rotary printing press, 100 the first chill roller surface or cylindrical jacket 3 has a given minimum temperature to prevent the oil in the printed ink from condensing.

The succeeding chill rollers 8 downline from the respective chill roller stand do require higher chill roller surface temperatures. This is greatly dependent upon the web material to be processed, namely, whether calandered or fine-lined paper stock is used in the rotary printing press 100.

Instead of having nine mixing chambers 16.1 to 24.1 arranged over the length or breadth of the chill roller 8, a different number of mixing chambers can be arranged to achieve the same even temperature profiles on the surface or cylinder jacket 3 of the respective chill roller 8. The supply openings 16.3 to 24.3 mentioned hereinbefore either can be realized as bores or as annularly extending slots or perforations formed on the circumference of the central supply pipe 12. It should be noted as well that the cross sections of the respective outlets 16.5 to 24.5 between the inner surface of the cylinder jackets 3 of the chill roller 8 and the end portions of the partitions 16 to 24 increase over the length or breadth of the chill roller 8.

Figure 4:
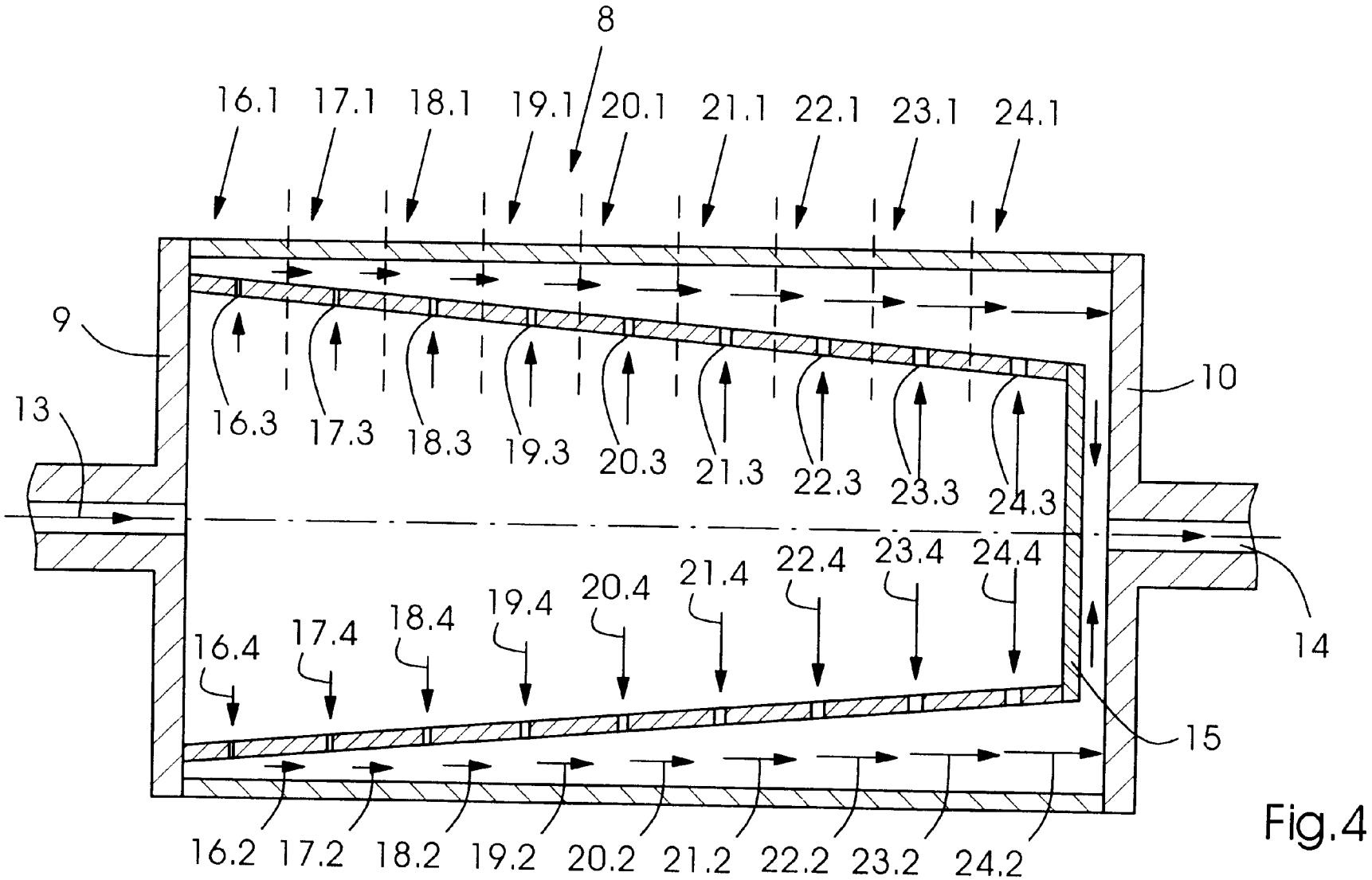
FIG. 4 is a view like that of FIG. 3 of an alternative embodiment of the chill roller according to the invention.

FIG. 4 illustrates a further embodiment of a chill roller 8 according to the invention, wherein a frustoconical central supply pipe together with a funnel-shaped flow region or chamber is provided. The chill roller 8 includes a conically tapering central supply pipe 15 fastened to an end face or flange 9 of the chill roller 8. The supply line 13 is connected to the first end face or flange 9, and an opposite second end face or flange 10 has the discharge line 14 connected thereto.

The downwardly tapered frustoconical end of the central supply pipe 15 is directed towards the discharge end of the chill roller 8. Due to the frustoconical shape of the central supply pipe 15, funnel-shaped flow regions are formed between the central supply pipe 15 and the inner surface of the chill roller 8.

Imaginary lines represented by broken lines in FIG. 4 are shown subdividing the funnel-shaped flow regions into different mixing zones 16.1 to 24.1 over the entire length or breadth of the chill roller 8. The subdivision corresponds to the subdivision shown in FIG. 3. Each mixing zone 16.1 to 24.1 is provided with a respective supply opining 16.3 to 24.3 for the coolant. In a manner similar to that of the supply inlets in the central supply pipe 12 of FIG. 3, the cross section of the respective supply opining 16.3 to 24.3 for the coolant in FIG. 4 increases over the length of the central supply pipe 15 in the chill roller 8.

In order to achieve a uniform or even temperature profile over the length or breadth of the chill roller 8, the rate of coolant flow into the individual mixing zones 16.1 to 24.1 should be kept constant. Only fresh coolant flow 16.4 flows through the supply opining 16.3 into the mixing zone 16.1. In the adjacent mixing zone 17.1, the ratio between resulting overflowing coolant flow 16.2 from the mixing zone 16.1 and the fresh coolant flow 17.4 for the mixing zone 17.1 is kept constant by the fact that the admixed fresh coolant flow 17.4 of the mixing zone 17.1 is slightly increased, because the resulting, overflowing coolant flow 16.2 is warmer than the fresh coolant flow 16.4 originally fed to this mixing zone 16.1. In view of the continuity equation, this applies to all of the mixing zones 17.1 to 24.1, except for the mixing zone 16.1, because in the latter no resulting overflowing coolant flow is present, but rather only a fresh coolant flow 16.4 is received in the mixing zone 16.1.

The rate of the coolant flows is kept constant over the length or breadth of the chill roller 8 due to the fact that the respective fresh coolant flows 17.4 to 24.4 to the mixing zones, as viewed over the length or breadth of the chill roller 8, increase proportionally to the overflowing, respectively resulting coolant flows 16.2 to 23.2 in the funnel-shaped flow zones. An even or uniform temperature profile on the chill roller 8 of the invention is thereby achieved. Because no flow impediments or obstructions are placed in the way of the coolant flow in the funnel-shaped flow regions, an even or uniform flow as well as a suitable heat transfer is attainable.

Because an even or uniform temperature profile is then provided over the length or breadth of the chill roller 8, the phenomenom of oil condensation on the surface of the chill roller 8 then no longer occurs. Furthermore, due to the even temperature distribution on the chill roller 8, there is no longer any tendency upon the part of the material web to run to one side on the circumference of the chill roller 8.

Figure 5:
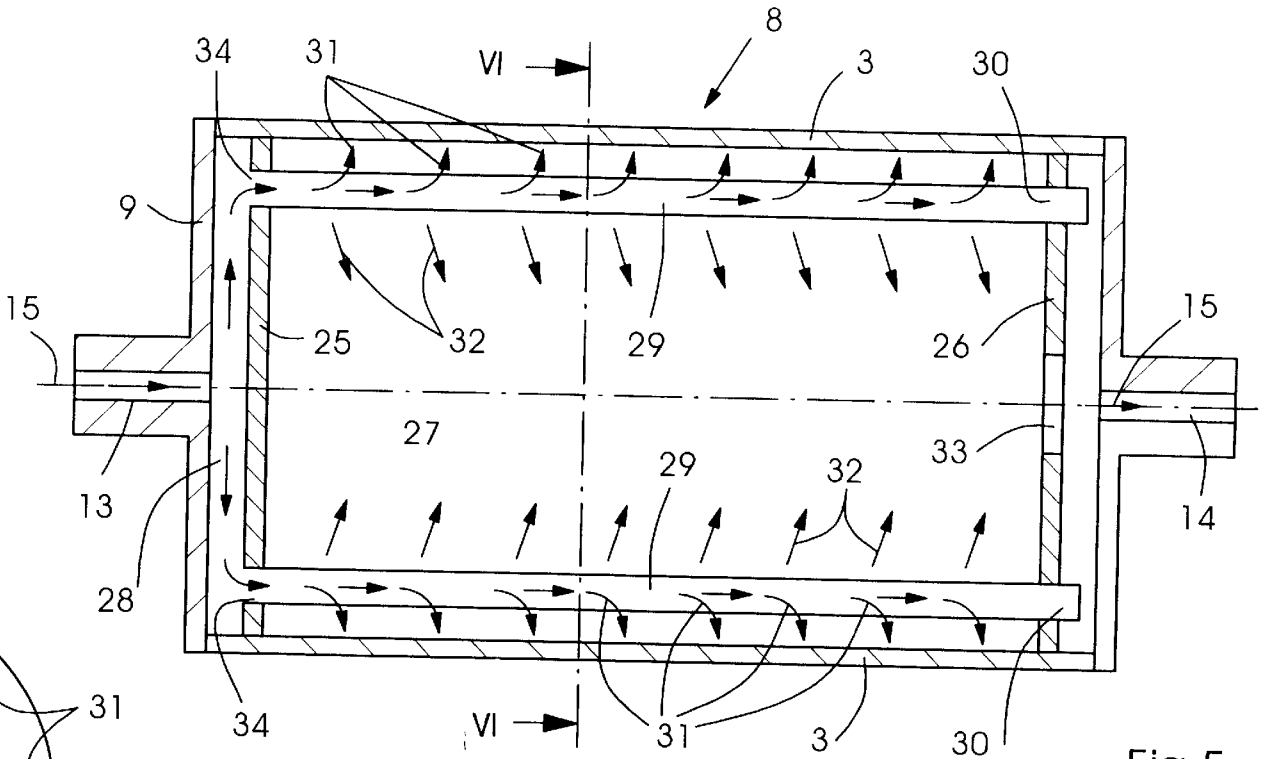
FIG. 5 is a view like those of FIGS. 3 and 4 of yet another alternative embodiment of the chill roller.

FIG. 5 shows an alternative embodiment of a chill roller according to the invention. In this chill roller 8, that has a first end face or flange 9 and a second end face or flange 10, a multiplicity of transport pipes 29 for coolant are mounted close to the inner surface of the cylinder jacket 3 of the chill roller 8. The transport pipes 29 are attached to respective circular baffle plates 25 and 26 which are mounted close to the first and second end faces or flanges 9 and 10, respectively.

The transport pipes 29 are supplied with coolant from the distribution region 28 between a baffle plate 25 and a first end face or flange 9 of the chill roller 8. The transport pipes 29 are arranged in annular form as is apparent from FIG. 6. In the baffle plate 25, respective pipe inlets 34 are assigned to each transport pipe 29. From both transport pipes 29 shown in FIG. 5, heat-transferring flows 31 of coolant emerge for contacting the inner surface of the cylinder jacket 3. The contact of the heat-transferring coolant flows 31 with the inner surface of the cylinder jacket 3 of the chill roller 8 occurs simultaneously over the entire length or breadth of the respective transport pipes 29 and the chill roller 8. The coolant sweeps over the inner surfaces of the cylinder jacket 3 of the chill roller 8 simultaneously and is forced to contact the inner surface of the cylinder jacket 3 because respective end portions 30 of the transport pipes 29 proximal to the discharge pipe 14 are closed. The arrows 32 depict a recirculation flow of the coolant directed towards the interior of the chill roller 8 after the coolant has contacted the inner surface of the cylinder jacket 3. The recirculation flow represented by the arrows 32 is directed from the inner surface of the cylinder jacket 3 towards the interior of the chill roller 8 after it has made contact with the inner surface of the cylinder jacket 3. The recirculation flow passes from the interior of the chill roller 8 through a discharge opening 33 towards the discharge pipe 14.

Figure 6:
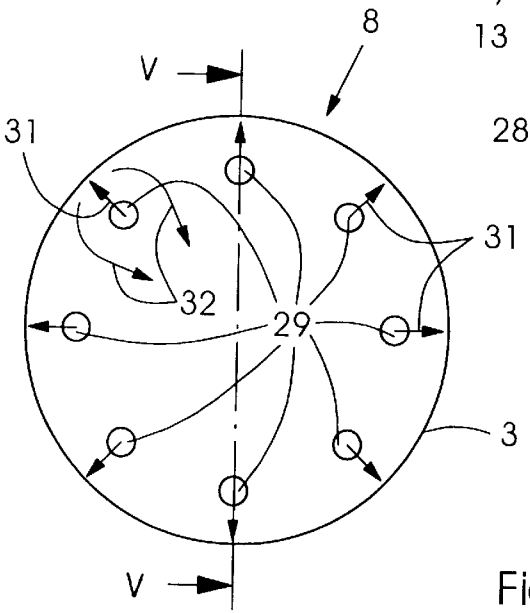
FIG. 6 is a cross-sectional view of FIG. 5 taken along the line VI—VI in the direction of the arrows.

The arrangement of the transport pipes 29 for the coolant is shown in FIG. 6, which is a cross-sectional view of FIG. 5 taken along the line VI—VI therein in the direction of the arrows. Conversely, the longitudinal sectional view of the chill roller 8 shown in FIG. 5 is taken along the line V—V in FIG. 6. The recirculation flow 32 towards the interior of the chill roller 8 described hereinbefore in connection with FIG. 5 is further shown in FIG. 6.

Figure 7:
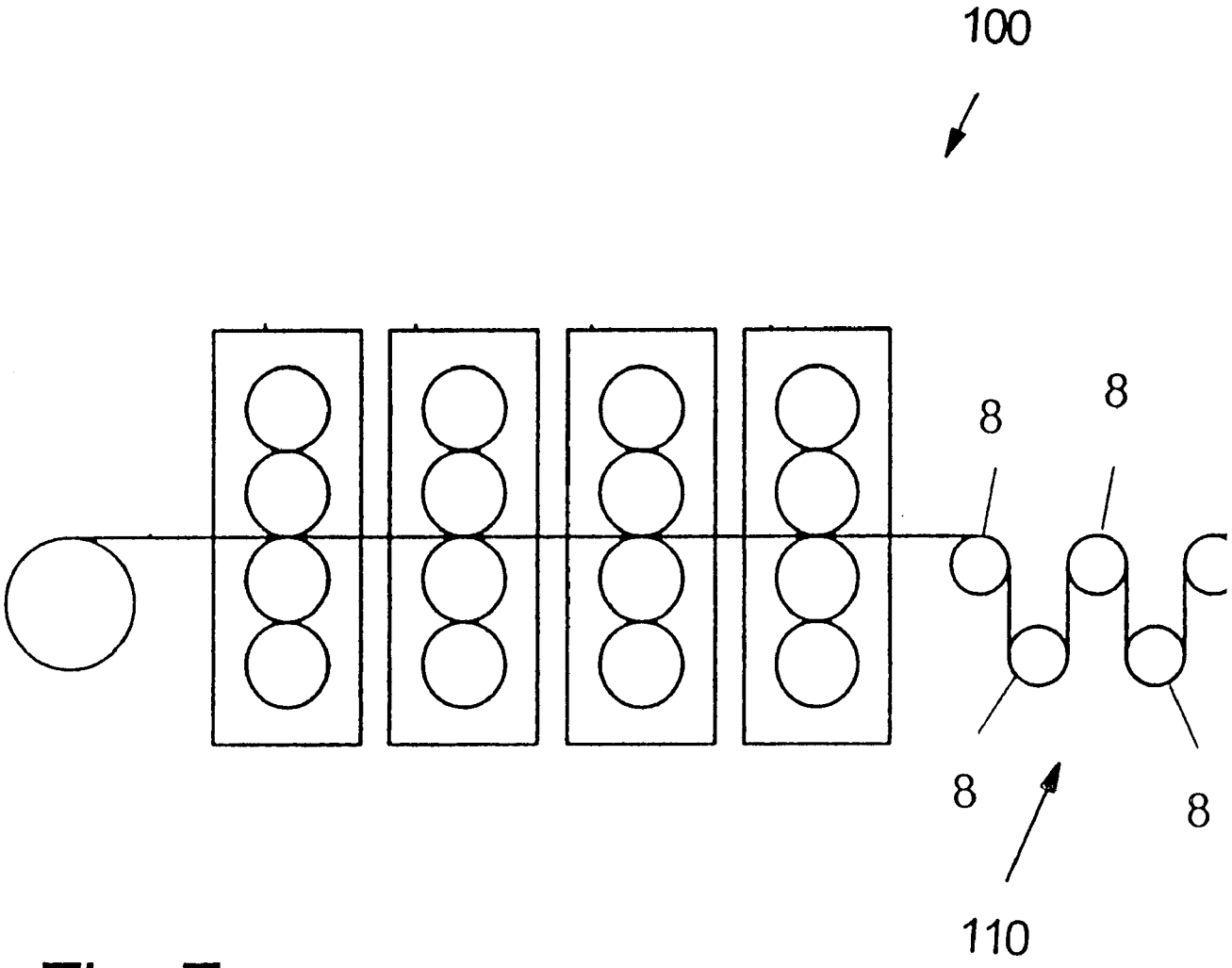
FIG. 7 is a side view of a printing press with a plurality of chill rollers.

FIG. 7 shows a rotary printing press 100 with a chill roller stand 110 having a plurality of chill rollers 8.

What is claimed is:

1. A chill roller for regulating temperature uniformly, comprising:

a cylindrical jacket including a first flange and a second flange, said cylindrical jacket defining an axis and a hollow portion;

a frustoconical shaped supply pipe having a downwardly tapered end and an upwardly tapered end, said frustoconical shaped supply pipe being coaxially mounted inside said cylindrical jacket, said upwardly tapered end sealing with said first flange, said downwardly tapered end being proximate said second flange; said frustoconical shaped supply pipe having a plurality of supply openings formed thereon, said supply openings each creating a mixing zone in said hollow portion;

a supply line attached to said first flange; and a discharge pipe connected to said second flange.

2. The chill roller according to claim 1, wherein each of said mixing zones are connected in series.

3. A The chill roller according to claim 2, further comprising:

a device for maintaining an equal coolant flow throughout each of said mixing zones.

4. The chill roller according to claim 1, wherein each of said mixing zones have a temperature therein equal to the temperature in said frustoconical shaped supply pipe.

5. The chill roller according to claim 1, wherein said outlets are annular openings.

6. The chill roller according to claim 1, wherein said outlets are bores.

7. The chill roller according to claim 1, wherein said outlets are perforations formed in said frustoconical shaped supply pipe.

8. The chill roller according to claim 1, wherein the outlets, respectively, have a cross section that increases from said first flange to said second flange.

9. The chill roller according to claim 1, having a funnel-shaped flow region defined between said jacket and said frustoconical shaped supply pipe.

10. A chill roller stand comprising:

a plurality of chill rollers for regulating temperature uniformly, each having:

a cylindrical jacket including a first flange and a second flange, said cylindrical jacket defining an axis and a hollow portion;

a frustoconical shaped supply pipe having a downwardly tapered end and an upwardly tapered end, said frustoconical shaped supply pipe being coaxially mounted inside said cylindrical jacket, said upwardly tapered end sealing with said first flange, said downwardly tapered end being proximate said second flange; said frustoconical shaped supply pipe having a plurality of supply openings formed thereon, said supply openings each creating a mixing zone in said hollow portion;

a supply line attached to said first flange; and a discharge pipe connected to said second flange.

11. A rotary printing press having a chill roller stand comprising a plurality of chill rollers for regulating temperature uniformly, each having:

a cylindrical jacket including a first flange and a second flange, said cylindrical jacket defining an axis and a hollow portion;

a frustoconical shaped supply pipe having a downwardly tapered end and an upwardly tapered end, said frustoconical shaped supply pipe being coaxially mounted inside said cylindrical jacket, said upwardly tapered end sealing with said first flange, said downwardly tapered end being proximate said second flange; said frustoconical shaped supply pipe having a plurality of supply openings formed thereon, said supply openings each creating a mixing zone in said hollow portion;

a supply line attached to said first flange; and a discharge pipe connected to said second flange.

* * * * *